US005906264A

United States Patent [19]

Black et al.

[11] Patent Number: 5,906,264

[45] Date of Patent: May 25, 1999

[54] APPARATUS AND METHOD FOR PRODUCING TRUSS PLATE BUNDLES

[75] Inventors: William H. Black; William Anderson, both of Edenton, N.C.

[73] Assignee: Tee-Lok Corporation, Edenton, N.C.

[21] Appl. No.: 08/925,874

[22] Filed: Sep. 9, 1997

[51] Int. Cl.[6] ..... B65G 47/24

[52] U.S. Cl. ..... 198/374; 198/406; 198/436

[58] Field of Search ..... 198/374, 406, 198/409, 370.07, 597, 447, 436, 448

[56] References Cited

U.S. PATENT DOCUMENTS

| | | | |
|---|---|---|---|
| 2,271,632 | 2/1942 | Diehl | 93/93 |
| 2,962,849 | 12/1960 | Layton, Jr. | 198/409 |
| 2,996,721 | 8/1961 | Black | 1/149 |
| 3,100,301 | 8/1963 | Black | 1/60 |
| 3,377,905 | 4/1968 | McAlpine | 85/13 |
| 3,416,283 | 12/1968 | Sanford | 52/693 |
| 3,473,362 | 10/1969 | Black et al. | 72/326 |
| 3,498,170 | 3/1970 | Sanford | 85/13 |
| 3,760,980 | 9/1973 | Ioffe | 198/400 |
| 3,833,111 | 9/1974 | Sterling et al. | 198/380 |
| 3,880,286 | 4/1975 | Wegener | 206/386 |
| 3,963,452 | 6/1976 | Jureit et al. | 29/193.5 |
| 4,225,095 | 9/1980 | Jureit et al. | 242/1 |
| 4,251,168 | 2/1981 | Groetschel | 405/288 |
| 4,265,354 | 5/1981 | Sinnema | 198/374 |
| 4,286,638 | 9/1981 | Connolly et al. | 198/436 |
| 4,440,289 | 4/1984 | Weis | 198/448 |
| 4,965,740 | 10/1990 | Schofield et al. | 364/512 |
| 5,218,813 | 6/1993 | Seidel | 53/299 |
| 5,265,722 | 11/1993 | Schmidmeister | 206/321 |
| 5,392,908 | 2/1995 | Black, Jr. | 206/321 |
| 5,630,697 | 5/1997 | Black, Jr. | 414/798.6 |
| 5,636,494 | 6/1997 | Black, Jr. | 53/399 |
| 5,638,658 | 6/1997 | Black, Jr. | 53/399 |
| 5,640,832 | 6/1997 | Black, Jr. | 53/442 |
| 5,655,399 | 8/1997 | Black, Jr. | 72/325 |
| 5,678,395 | 10/1997 | Black, Jr. | 53/542 |
| 5,730,579 | 3/1998 | Keck et al. | 198/370.07 |

OTHER PUBLICATIONS

Affidavit of Donald J. Bender dated Apr. 27, 1995.
Affidavit of Todd L. Robinson dated May 2, 1995.
Tee–Lok, Inc. Truss Plate Package Photos (Photos 1–5).
"Finland's Makron Company Is A Master Machinery Producer" *Automated Builder*, pp. 1,4,14 and 15 (Oct. 1992).
Makron Truss Plate Line TPL 50–8 Brochure.
Makron Plate Line Video.

*Primary Examiner*—Joseph E. Valenza
*Assistant Examiner*—Khoi H. Tran
*Attorney, Agent, or Firm*—Myers Bigel Sibley & Sajovec

[57] ABSTRACT

An automated apparatus for orienting truss plates, and in particular truss plates, such as those greater than 6 inches in width, that are typically formed from a single sheet of steel, comprises: a generally horizontally-disposed platform shelf; first and second receiving channels; a sweeper block; and a reciprocal movement unit for reciprocally moving the sweeper block. The platform shelf, which is positioned to receive truss plates from a truss plate forming unit, has an upper face and a pair of opposed lateral edges. The receiving channels are positioned laterally of a respective one of the platform shelf lateral edges and below its upper face. Each of the receiving channels is sized and configured such that a truss plate falling from the upper face and received therein takes and maintains an orientation in which the backing member of the truss plate is generally upright. The sweeper block is positioned above the upper face. The reciprocal movement means moves the sweeper block transversely between a first position above the first receiving channel and a second position above the second receiving channel. The reciprocal movement means is configured so that the sweeper block passes over the upper face while moving between the first and second positions. The sweeper block is deployed at a height such that it contacts a truss plate positioned on the upper face and sweeps the truss plate over one of the lateral edges into one of the receiving channels. This action is repeated as the sweeper block is moved over the other receiving channel; in doing so, it sweeps another truss plate positioned on the upper face into the other receiving channel.

18 Claims, 3 Drawing Sheets

APPARATUS AND METHOD FOR PRODUCING TRUSS PLATE BUNDLES

FIELD OF THE INVENTION

The present invention relates generally to the packaging of truss plates, and in particular relates to the automated packaging thereof.

BACKGROUND OF THE INVENTION

Truss plates are generally employed to join planks of lumber that form floor and roof trusses used in residential housing. Truss plates typically comprise a backing plate and an array of sharp spike-like impaling members that extend outwardly from one side of the backing plate. Adjacent planks of a truss with coplanar surfaces can be permanently joined by pounding or pressing the backing member of a truss plate so that its impaling members penetrate the planks.

In the past truss plates were typically packaged in boxes or cartons in no particular order whatsoever; they were simply strewn haphazardly within their container. If the container were emptied or if it were somehow removed or destroyed, the truss plates would spill and spread and were quite hazardous until they were retrieved and restored. As a result, truss plates were generally stored on-site in their packaging cartons until use.

As a solution to this problem, U.S. Pat. No. 5,392,908 to Black describes a truss plate packaging method and configuration in which truss plates are packaged in unitized bundles. The truss plates are arranged so that their respective backing members are substantially parallels with the peripheries of the backing members being substantially aligned. The truss plates are then interconnected with some interconnecting means, such as a strap that snugly wraps around the truss plates, to form a unitized bundle. Such a bundle can be conveniently shipped, stored, and handled in the manufacture of trusses.

A manufacturing apparatus for bundling truss plates in this manner is illustrated and described in U.S. Pat. No. 5,636,494 to Black (hereinafter the '494 patent), the disclosure of which is hereby incorporated herein in its entirety. This apparatus receives four truss plates as they exit a punch press. The plates are disposed horizontally and travel to a pair of horizontal shelves. They fall from either side of the shelves into four receiving channels that orient them generally vertically. These channels convey the truss plates to retractable stops, which halt the forward motion of the truss plates until all four truss plates are present. The stops are positioned so that, as the truss plates rest against them, the perimeters of the truss plates are substantially aligned. Retraction of the stops causes a pairing mechanism to direct the truss plates into two cooperating pairs, in which the impaling members of one truss plate of the pair extend toward the backing member of the other truss plate of the pair. The two cooperating pairs of truss plates are then conveyed to a receiving chamber, where they are stacked with other sets of cooperating pairs until a predetermined number of truss plates has been accumulated. The stacked truss plates are then conveyed as a stack to a banding station, where a plastic band is wrapped around the stack to form a truss plate bundle. Each truss plate bundle travels to an accumulation stage, from where a preselected number of truss plate bundles is gripped between a pair of elongate plates and lifted onto a pallet. This process continued until the pallet is filled with truss plate bundles. This manufacturing system has proven to be successful in automatically producing truss plate bundles.

Although this manufacturing system is satisfactory for the packaging of many truss plates, the system as illustrated may be unsatisfactory for orientating of wide truss plates. The system illustrated in the '494 patent is designed to receive four truss plates as they are formed simultaneously at the punch press from a single strip of steel. A pair of truss plates falls from each side of each shelf, so that their impaling members extend toward the other plate of the pair. This configuration is suitable for 3 inch wide truss plates, which can be formed from a 12 inch strip of steel, but may be less suitable for wider truss plates, such as 7, 8, or 9 inch wide truss plates. These wider truss plates are typically formed at the punch press one at a time from 7, 8, or 9 inch wide strips of steel (wider strip steel is less readily available). Thus, a system is needed to orient truss plates typically formed in a single stream of truss plates (i.e., wider than 6 inches).

SUMMARY OF THE INVENTION

In view of the foregoing, it is an object of the present invention to provide an apparatus for orienting wide truss plates, such as those formed one at a time from a single strip of steel, so that they can be paired with their impaling members extending toward one another.

It is another object of the present invention to provide a method for so orienting wide truss plates.

These and other objects are satisfied by the present invention, which provides an automated apparatus and associated method for orienting truss plates, and in particular truss plates, such as those greater than 6 inches in width, that are typically formed from a single sheet of steel. The apparatus comprises: a generally horizontally-disposed platform shelf; first and second receiving channels; a sweeper block; and reciprocal movement means for reciprocally moving the sweeper block. The platform shelf, which is positioned to receive truss plates from a truss plate forming unit, has an upper face and a pair of opposed lateral edges. The receiving channels are positioned laterally of a respective one of the platform shelf lateral edges and below its upper face. Each of the receiving channels is sized and configured such that a truss plate falling from the upper face and received therein takes and maintains an orientation in which the backing member of the truss plate is generally upright. The sweeper block is positioned above the upper face. The reciprocal movement means moves the sweeper block transversely between a first position above the first receiving channel and a second position above the second receiving channel. The reciprocal movement means is configured so that the sweeper block passes over the upper face while moving between the first and second positions. The sweeper block is deployed at a height such that it contacts a truss plate positioned on the upper face and sweeps the truss plate over one of the lateral edges into one of the receiving channels. This action is repeated as the sweeper block is moved over the other receiving channel; in doing so, it sweeps another truss plate positioned on the upper face into the other receiving channel.

This configuration enables the truss plates to be reoriented from a position in which their impaling members each face in the same direction into a position in which the impaling members of each truss plate extend toward the impaling members of another truss plate. Having been so oriented, the truss plates can then be aligned, stacked, and bundled in a truss plate bundling operation.

DETAILED DESCRIPTION OF THE PREFERRED EMBODIMENTS

The present invention will be described more particularly hereinafter with reference to the accompanying drawings. The invention is not intended to be limited to the illustrated embodiments; rather, these embodiments are intended to fully and completely disclose the invention to those skilled in this art.

The present invention relates to a method and apparatus for orienting truss plates. In the description of the present invention that follows, certain terms are employed to refer to the positional relationship of certain structures relative to other structures. As used herein, the term "forward" and derivatives thereof refer to the general direction truss plates travel as they move through the orientation station; this term is intended to be synonymous with the term "downstream", which is often used in manufacturing environments to indicate that certain material being acted upon is farther along in the manufacturing process than other material. Conversely, the terms "rearward" and "upstream" and derivatives thereof refer to the directions opposite, respectively, the forward and downstream directions. Together, the forward and rearward directions comprise the "longitudinal" dimension. As used herein, the terms "outer", "outward", "lateral", and derivatives thereof refer to the direction defined by a vector originating at the longitudinal axis of a given structure and extending horizontally and perpendicularly thereto. Conversely, the terms "inner", inward", and derivatives thereof refer to the direction opposite that of the outward direction. Together, the inward and outward directions comprise the "transverse" dimension.

Figures 1, 2:
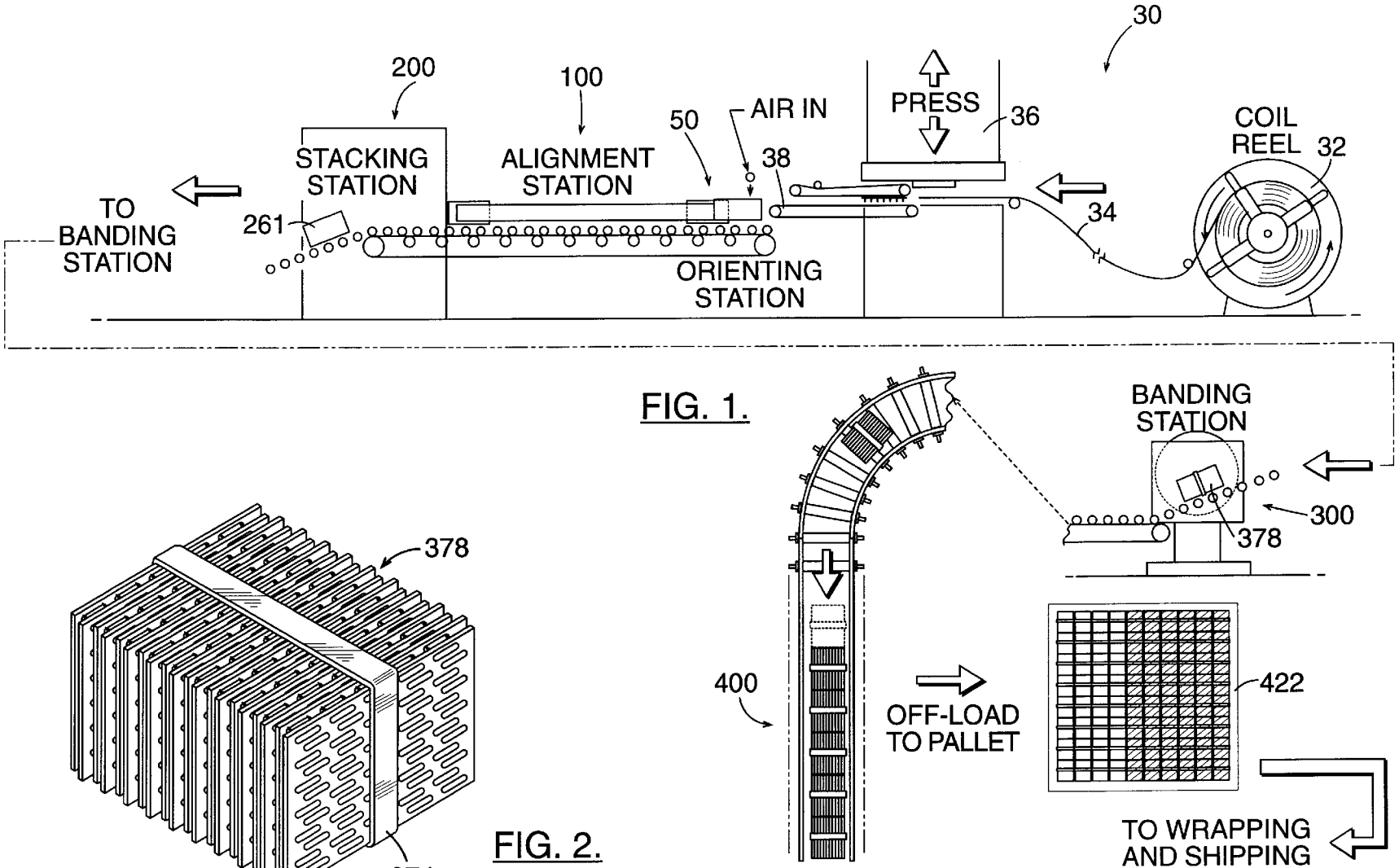
FIG. 1 is a schematic diagram of a truss plate bundle packaging apparatus according to the present invention.
FIG. 2 is a perspective view of a truss plate bundle produced by the apparatus shown in FIG. 1.

Referring now to the drawings, FIG. 1 illustrates schematically a truss plate packaging apparatus 30. The packaging apparatus 30 comprises a coil reel 32 that provides steel sheet 34, a stamping press 36 that forms truss plates 40 one at a time, an orientation station 50 that orients the truss plates 40 formed at the stamping press 36 so that their backing members are substantially parallel to a predetermined plane, an alignment station 100 that aligns pairs of truss plates 40 so that the peripheries of their backing members are substantially aligned, a stacking station 200 that stacks the oriented and aligned truss plates into a truss plate stack 261, a banding station 300 that encircles truss plate stacks 261 with an interconnecting strap 374 to produce a truss plate bundle 378 (FIG. 2), and an offloading station 400 that stacks the truss plate bundles 378 into a predetermined configuration on a pallet 422 for final enclosure and shipping.

The coil reel 32 (FIG. 1) stores the steel sheet 34, which typically ranges in thickness from between about 0.036 inches to 0.063 inches, in rolled form and provides it to the stamping press 36. In the illustrated embodiment, the steel sheet 34 is of sufficient width (measured in the transverse direction) that one truss plate 40 can be formed from each transverse strip of material. Most commonly the steel sheet 34 will be 7, 8, or 9 inches in width (i.e., its transverse dimension). The coil reel 32 can be any known to those skilled in this art for providing steel sheet to the stamping press 36; the skilled artisan will appreciate that other means for providing material to the stamping press 36 for truss plate formation, such as the manual feeding of flat strips of steel, can also be used with the present invention.

The stamping press 36 (FIG. 1) receives steel sheet 34 from the coil reel 32 and forms the truss plates 40 therefrom. Each of the truss plates 40 includes a generally planar backing member and a plurality of impaling members that extend from one side thereof The stamping press 36 is configured to strike out the impaling members of the individual truss plates 40, then slice the steel sheet material 34 transversely to form the truss plates 40 with backing members of the desired size. The stamping press 36 forms one truss plate at a time, and strikes out impaling members at a rate of between about 25 and 500 strokes per minute. It is preferred that the stamping press 36 be configured so that, as the truss plates 40 emerge therefrom, the impaling members extend downwardly, although stamping presses that produce truss plates that emerge from the stamping process with their impaling members extending upwardly can also be used with the present invention. Those skilled in this art will appreciate that, although the aforementioned stamping press 36 is preferred, other stamping presses, and indeed other apparatus for forming truss plates, such as roll formers, can also be used in conjunction with the present invention.

The truss plates 40 (shown in FIG. 2 formed into a bundle 378) can take a variety of dimensions. For example, the thickness of the backing member and the impaling members, which is generally dependent upon the thickness of the sheet material 34, can vary from between about 0.036 and 0.063 inches, the length of the backing member can vary from about 1 inches to about 20 inches, and the backing member width can vary by a similar range. Most commonly, the apparatus 30 illustrated herein will be used to form truss plates having widths of 7, 8 or 9 inches due to the availability of sheet steel in 7, 8, and 9 inch widths. The impaling members can be arranged in perpendicularly disposed linear rows and columns, in linear columns with staggered rows (as illustrated in FIG. 2), or other arrangements. It is preferred that the impaling members be arranged so that two truss plates can be formed into a cooperating pair, in which the truss plates are in overlying contacting parallel relationship and in which the impaling members of each of the truss plates of the pair extend toward the backing member of the other truss plate of the pair. Truss plates suitable for use with the present invention are also discussed in U.S. Pat. No. 5,392,908 and in co-pending and co-assigned U.S. patent application Ser. No. 08/446,223, the disclosures of which are incorporated herein by reference in its entireties.

Upon exiting the stamping press 36, the truss plates 40 are conveyed via a belt conveyor 38 to the orientation station 50 (FIGS. 3 through 6). In the illustrated embodiment, the truss plates 40 are conveyed on the belt conveyor 38 with their length dimension extending longitudinally and with their impaling members extending downwardly.

The orientation station 50 (FIG. 3) comprises a platform shelf 52, a reciprocating sweeper unit 60 The orientation station 50 receives truss plates 40 one at a time from the stamping press 36 and places them in a generally vertical orientation, with truss plates alternatively positioned in the receiving channels 80*a*, 80*b*.

The platform shelf 52 (FIGS. 3 through 6) extends downstream from the forward end of the belt conveyor 38. It comprises a generally planar upper face 54 and a lateral wall 56 having a protruding base 53. The upper face 54 and the lateral wall 56 merge at a sharp edge 55. The platform shelf 52 is positioned so the truss plates 40 are conveyed from the belt conveyor 38 onto the platform shelf upper face 54 (FIG. 5). The upper face 54 is of a width such that the fall width of each truss plate 40 is supported thereby, with none of the truss plate 40 overhanging the edges of the upper face 54; preferably, the upper face is between 3 and 6 inches in width. Notably, the upper face is slightly wider at its rearward end than at its forward end such that the sharp edges 55 define an angle of between 2 and 10 degrees with each other.

The sweeper unit 60 includes a pair of guide rods 64*a*, 64*b*, a pneumatic cylinder unit 66, a slide block 72, and a sweeper block 76. The guide rods 64*a*, 64*b* are mounted on stationary mounting brackets 62*a*, 62*b* that are located downstream of the platform shelf 52. They extend horizontally and transversely across the receiving channels 80*a*, 80*b*, with the guide rod 64*a* being spaced apart and positioned rearwardly from the guide rod 64*b*. The cylinder unit 66 is a conventional pneumatic cylinder unit comprising a hollow cylinder 68 and a retractable shaft 70. The cylinder unit 66 is fluidly connected to an air supply (not shown) that, upon an appropriate signal from a controller (also not shown), exerts positive or negative pressure within the cylinder 68 to cause the shaft 70 to extend or retract. The cylinder unit 66 is positioned such that the shaft 70 extends transversely between the guide rods 64*a*, 64*b*.

The slide block 72 is attached to the free end of the cylinder shaft 70. The slide block 72 includes two apertures (not shown) that extend transversely therethrough. The guide rods 64*a*, 64*b* are received in these apertures, thereby enabling the slide block 72 to slide upon the guide rods 64*a*, 64*b* as the shaft 70 extends or retracts from the cylinder 68.

An extension arm 74 extends rearwardly and longitudinally from the slide block 72 and attaches to the sweeper block 76. The extension arm 74 extends rearwardly a sufficient length that the sweeper block 76 is positioned over the platform shelf 52. Illustratively and preferably, the sweeper block 76 is tapered to be narrower at its downstream end; a pair of lateral faces 78*a*, 78*b* that define the taper are angled relative to each other at an angle of between about 2 and 10 degrees to match that of the sharp edges 55 of the platform shelf 52.

Figure 5:
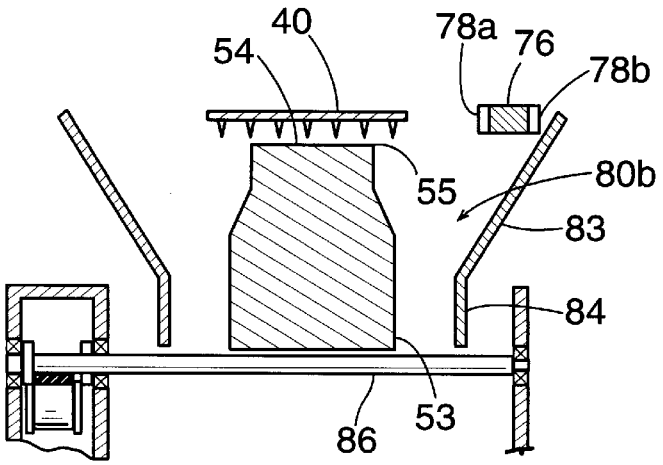
FIG. 5 is a cross-sectional view taken along lines 5—5 of FIG. 4 showing the horizontal orientation of a truss plate as it exits the belt conveyor, with the sweeper block shown in its extended position.
Figure 6:
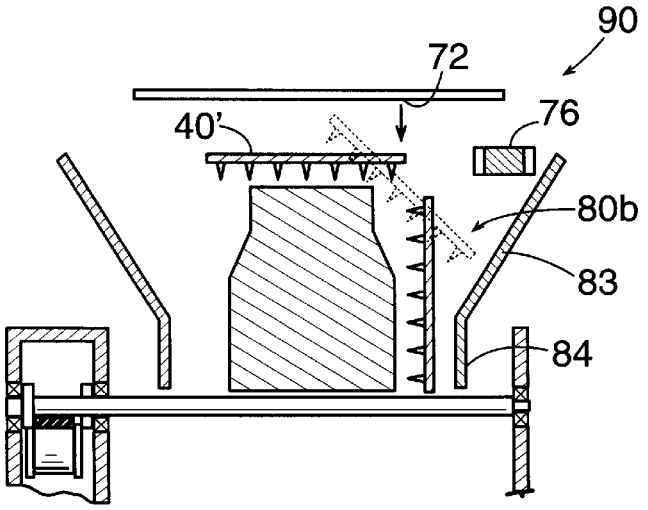
FIG. 6 is a cross-sectional view of the orientation station of FIG. 3 showing how a truss plate is pushed from the upper face of the horizontal shelf into another receiving channel by the sweeper block in its extended position.

The receiving channel 80*a* (FIGS. 3 through 6) is positioned laterally of the platform shelf 52 and is defined by the lateral wall 56 of the platform shelf 54, a lateral ramp 82, and a series of rollers 86. The lateral ramp 82, which extends forwardly from the downstream end of the belt conveyor 38, includes a sloping face 83 that slopes inwardly from its upper to lower end and a vertical face 84 positioned beneath the lower end of the sloping face 59. The vertical face 84 is spaced from the shelf base 53 so that a truss plate 40 dropping from the platform shelf upper face 54 can take and maintain a generally vertical orientation within the receiving channel 80 (FIG. 6). The vertical orientation of the truss plate 40 is encouraged by the sloping disposition of the sloping face 83, as the lateral edge of the falling truss plate 40 strikes the surface of the lateral ramp 82 and slides downwardly into the receiving channel 80*a*.

The receiving channel 80*b* is a mirror image structure of the receiving channel 80*a* about a vertical plane of symmetry that divides the platform shelf longitudinally. As such, the description above regarding the receiving channel 80*a* is equally applicable to the receiving channel 80*b*, with the understanding that the positions and orientations of the structures of the receiving channel 80*b* are mirror images of the structures of the receiving channel 80*a*.

Figure 5A:
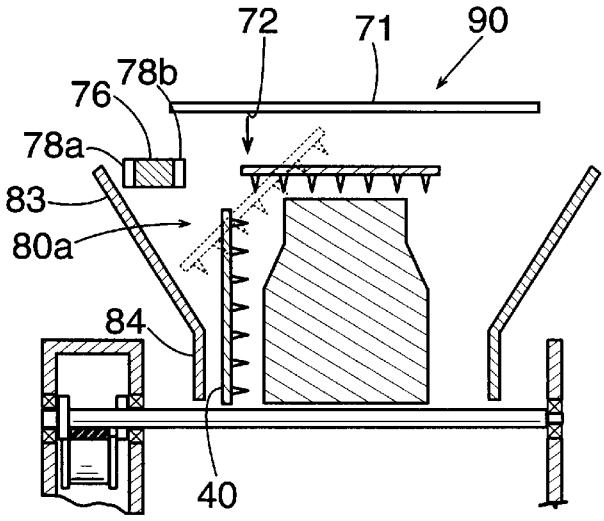
FIG. 5A is a cross-sectional view of the orientation station of FIG. 3 showing how a truss plate is pushed from the upper face of the horizontal shelf into a receiving channel by the sweeper block in its retracted position.

The blower 90 comprises a manifold 71 mounted transversely above the shelf upper face 54 (see FIGS. 5A and 6). The manifold 71 includes two nozzles 72,.each of which is directed downwardly and positioned above the upstream end of a respective receiving channel 80*a*, 80*b*. The manifold 71 is fluidly connected to an air source (not shown) that provides a continuous fluid stream for the nozzles 72.

Figure 3:
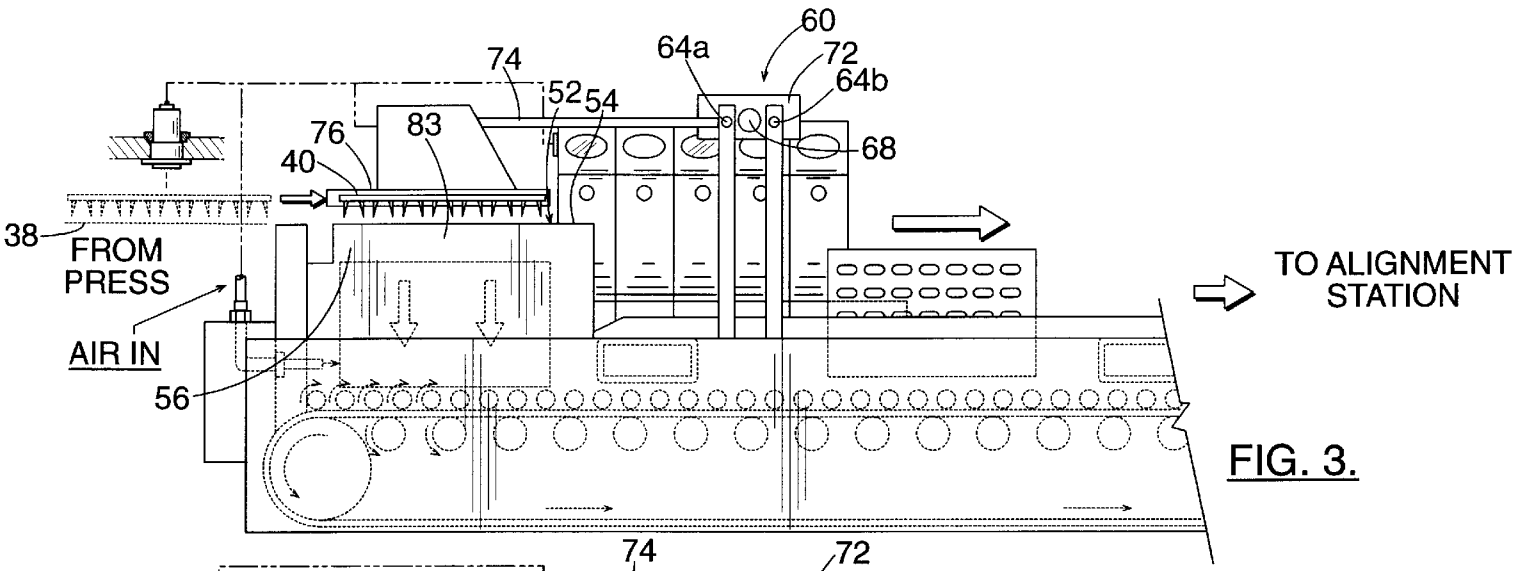
FIG. 3 is a partial side view of the orientation station of FIG. 1 illustrating the entry and orientation of truss plates therein.
Figure 4:
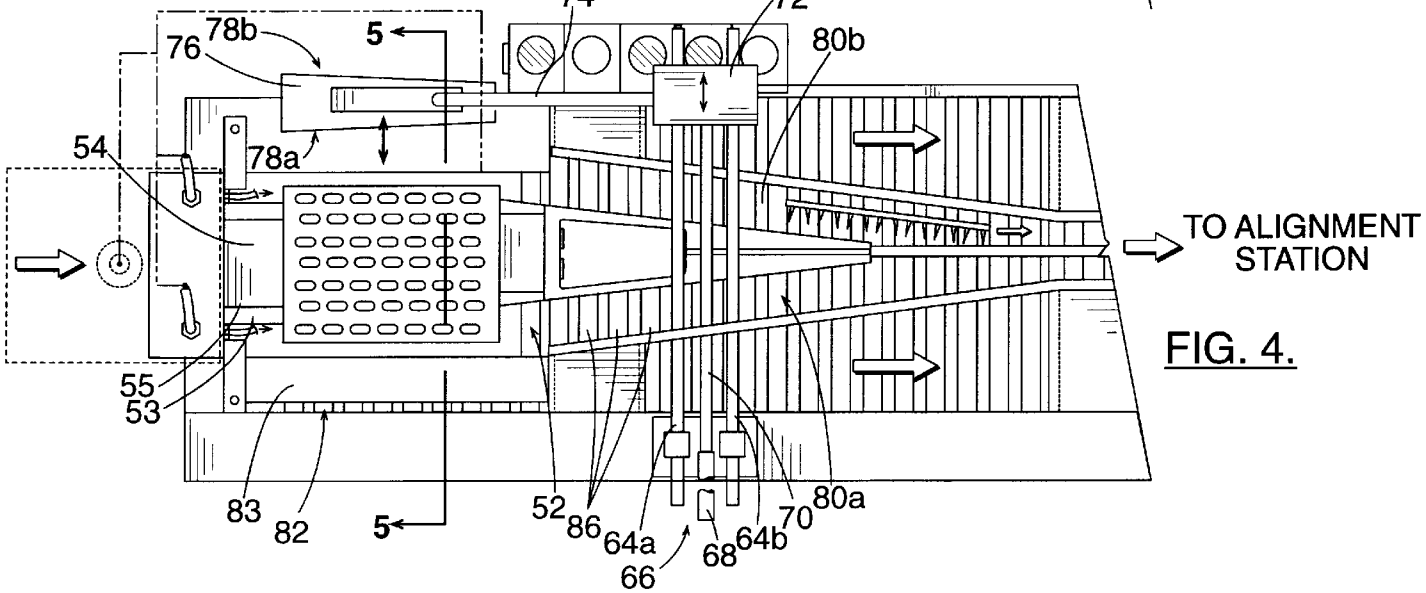
FIG. 4 is a top view of the orientation station of FIG. 3.

In operation, truss plates 40 exit the stamping press 36 as a stream of single truss plates and are deposited by the belt conveyer 38 onto the upper face 54 of the platform shelf 52 (FIGS. 3 through 5). The truss plates 40 arrive horizontally-disposed, with their impaling members extending downwardly. As shown in FIGS. 4 and 5, the shaft 70 of the cylinder unit 66 is extended, which positions the sweeper block 76 over the receiving channel 80*b*.

The cylinder unit 66 is actuated to retract by a proximity detector (not shown) that detects the presence of a truss plate 40 on the conveyor 38. Retraction of the shaft 70 draws the slide block 72 to a position over the receiving channel 80*a* (FIG. 5A). This action, in turn, draws the sweeper block 76 to a position over the receiving channel 80*a*. As the sweeper block 76 moves over the platform shelf 52, the lateral face 78*a* strikes the transverse edge of the truss plate 40 and sweeps it over the edge 55 of the upper face 54 of the platform shelf 52. Once a significant portion of the truss plate 40 is unsupported by the upper face 54, the truss plate 40 (aided by air blowing out of the nozzle 72 positioned over the receiving channel 80*a*) rotates 90 degrees and falls into the receiving channel 80*a*, where it is retained in a generally vertical orientation.

The orientation of the truss plate 40 is also aided by the presence of the sharp edge 55 and the protruding base 53 of the platform shelf 52. The sharp edge 55 is configured such that, as truss plate 40 begins to fall, the outermost impaling members of the truss plate 40 in contact with the upper face 54 catch on the sharp edge 55 rather than sliding over it. This temporary fixing of these impaling members causes the truss plate 40 to rotate rather than slide. As the lateral edge of the truss plate 40 descends and its lateral impaling members strike the protruding base 53, the impaling members caught by the sharp edge 55 are jolted free of the edge 55, and the truss plate 40 continues to fall into the receiving channel 68*a*. Thus, the sharp edge 55 and the protruding base 53 help to control the rotation and descent of the truss plate 40 into the receiving channel 68*a*.

After the truss plate 40 has been swept into the receiving channel 80*a* by the sweeper block 76, the conveyor belt 38 delivers another truss plate (designated in FIG. 6 as 40') to the platform shelf 52. The cylinder unit 66 is actuated to extend the shaft 70, which slides the slide block 72 to a position over the receiving channel 80*b*. The sweeper block 76 is drawn over the platform shelf and sweeps the truss plate 40' into the receiving channel 80*b*, where it takes a generally vertical orientation.

Notably, after each of the truss plates 40, 40' has fallen into and been oriented by, respectively, the receiving channels 80*a*, 80*b*, the backing members of the truss plates 40, 40' are generally parallel, and the impaling members of each of the truss plates 40, 40' extend toward the backing member of the other truss plate 40', 40. For reasons described in detail hereinafter and in U.S. Pat. No. 5,392,908 cited above, this relative orientation enables these truss plates to be formed into cooperating truss plate pairs at the alignment station 100. From there, cooperating pairs of truss plates can be stacked at the stacking station 200, bundled at the banding station 300, and off loaded onto a pallet for shipping at the offloading station 400. Exemplary configurations and operations of these downstream stations are described in detail in the '494 patent and need not be described in detail herein.

Those skilled in this art will appreciate that, although the configuration illustrated herein is preferred, other structures for orienting truss plates from a first orientation exiting the stamping press, in which their impaling members extend in the same direction, to a second orientation, in which pairs of plates have their impaling members extending toward one another, can also be employed with the present invention. For example, pick-and-place machines and robotic arms can also be employed. It is preferred that orienting station be configured to receive and act upon truss plates that exit the stamping press with their impaling members extending downwardly, as stamping presses that provide truss plates in this condition can typically operate at a higher production rate. Also, it is preferred that the orienting station orient the truss plates from a horizontal disposition to a vertical disposition, as truss plate bundles that have their backing members vertically disposed tend to stack upon one another more easily.

The foregoing demonstrates that the orienting station described herein expands upon the capabilities of prior truss plate bundling systems. The employment of the sweeping member enables truss plates exiting the press to be oriented so that their impaling members face one another, which allows these truss plates to be easily formed into cooperating pairs for bundling.

The foregoing embodiment is illustrative of the present invention, and is not to be construed as limiting thereof. The invention is defined by the following claims, with equivalents of the claims to be included therein.

That which is claimed is:

1. An apparatus for orienting truss plates, each of said truss plates comprising a generally planar backing member and a plurality of impaling members extending from one side thereof, said apparatus comprising:

a generally horizontally-disposed platform shelf, said platform shelf having an upper face and a pair of opposed lateral edges;

first and second receiving channels, each of said receiving channels being positioned laterally of a respective one of said platform shelf edges and below said upper face, each of said receiving channels being sized and configured such that a truss plate falling from said upper face and received therein takes and maintains an orientation in which the backing member of the truss plate is generally upright;

a sweeper block positioned above said upper face; and reciprocal movement means for reciprocally moving said sweeper block transversely between a first position above said first receiving channel and a second position above said second receiving channel, said reciprocal movement means being configured so that said sweeper block passes over said upper face while moving between said first and second positions at a height such that said sweeper block contacts a truss plate positioned on said upper face and sweeps said truss plate over one of said lateral edges into one of said receiving channels.

2. The apparatus defined in claim 1, wherein said reciprocal movement means comprises:

a pair of guide rods positioned downstream of said platform shelf and extending transversely over said first and second receiving channels;

a slide block slidably attached to said guide rods; and an extension arm attached to said slide block and said sweeper block.

3. The apparatus defined in claim 2, wherein said reciprocal movement means further comprises a pneumatic cylinder unit having a cylinder and a shaft extendable therefrom, said shaft being attached to said slide block, said cylinder unit being configured such that extension of said shaft from said cylinder moves said slide block along said guide rods so that said sweeper block move from said first position to said second position.

4. The apparatus defined in claim 1, wherein said sweeper block has opposed lateral faces, said lateral faces being oriented such that said sweeper block is tapered, with its upstream width dimension being greater than its downstream width dimension.

5. The apparatus defined in claim 4, wherein said lateral faces are oriented such that they form an angle of between about 2 and 10 degrees with one another.

6. The apparatus defined in claim 1, further comprising:

truss plate forming means positioned upstream from said platform shelf; and conveying means for conveying truss plates from said truss plate forming means to said upper face.

7. The apparatus defined in claim 6, wherein said truss plate forming means and said conveying means are configured to convey truss plates to said upper face such that the impaling members of said truss plates extend downwardly.

8. The apparatus defined in claim 1, further comprising first and second air nozzles positioned above said first and second channels, each of said nozzles being configured to direct an airstream downwardly onto a truss plate positioned over one of said lateral edges to urge the truss plate to fall from said upper face into a respective receiving channel.

9. The apparatus defined in claim 1, wherein said platform shelf has a transverse dimension of between about 3 and 6 inches.

10. A method of orienting truss plates, each of said truss plates comprising a generally planar backing member and a plurality of impaling members extending from one side thereof, the method comprising the steps of:

conveying a first truss plate to a generally horizontally-disposed upper face of a platform shelf, said platform shelf having first and second opposed lateral edges;

sweeping said first truss plate in a first direction from said upper face into a first receiving channel, said first receiving channel positioned laterally from said first platform shelf lateral edge and below said upper face;

conveying a second truss plate onto said upper face; and sweeping said second truss plate in a second direction opposite said first direction from said upper face into a second receiving channel, said second receiving channel being positioned laterally of said second platform shelf edge;

each of said receiving channels being sized and configured such that a truss plate falling from said upper face and received therein takes and maintains an orientation in which the backing member of the truss plate is generally upright.

11. The method defined in claim 10, wherein said first and second sweeping steps are performed with a sweeper block that reciprocates between a first position above said first receiving channel and a second position above said second receiving channel, said sweeper block passing over said upper face while moving between said first and second positions at a height such that said sweeper block contacts a truss plate positioned on said platform shelf and sweeps said truss plate over one of said lateral edges into one of said receiving channels.

12. The apparatus defined in claim 11, wherein said sweeper block is attached to a pneumatic cylinder unit having a cylinder and a shaft extendable therefrom, said shaft being connected with said sweeper block, and wherein extension of said shaft from said cylinder causes said sweeper block to move between said first and second positions.

13. The method defined in claim 10, wherein said sweeper block has opposed lateral faces, said lateral faces being oriented such that said sweeper block is tapered, with its upstream width dimension being greater than its downstream width dimension.

14. The method defined in claim 13, wherein said lateral faces are oriented such that they form an angle of between about 2 and 10 degrees with one another.

15. The method defined in claim 10, farther comprising the step of forming said truss plates prior to said first conveying step.

16. The method defined in claim 15, wherein said forming step comprises forming said truss plates such that the impaling members of said truss plates extend downwardly.

17. The method defined in claim 10, further comprising the step of directing an airstream downwardly onto said first truss plate as it is swept into said first receiving channel.

18. The method defined in claim 10, wherein said platform shelf has a transverse dimension of between about 3 and 6 inches.

* * * * *